US009517879B2

(12) United States Patent
Chawla et al.

(10) Patent No.: US 9,517,879 B2
(45) Date of Patent: Dec. 13, 2016

(54) FOLDABLE TRANSPORT CONTAINER WITH HORIZONTALLY SLIDABLE SIDE WALLS AND METHOD FOR FOLDING SAID CONTAINER

(75) Inventors: Anoop Chawla, New Delhi (IN); Sudipto Mukherjee, New Delhi (IN)

(73) Assignees: Indian Institute of Technology, New Delhi (IN); Simpri Investments Limited, Hong Kong (CN)

( * ) Notice: Subject to any disclaimer, the term of this patent is extended or adjusted under 35 U.S.C. 154(b) by 1244 days.

(21) Appl. No.: 12/532,398

(22) PCT Filed: Dec. 11, 2007

(86) PCT No.: PCT/IN2007/000579
§ 371 (c)(1),
(2), (4) Date: Sep. 21, 2009

(87) PCT Pub. No.: WO2008/114273
PCT Pub. Date: Sep. 25, 2008

(65) Prior Publication Data

US 2010/0133264 A1 Jun. 3, 2010

(30) Foreign Application Priority Data

Mar. 21, 2007 (IN) ..... 620/DEL/2007

(51) Int. Cl.
*B65D 19/18* (2006.01)
*B65D 88/52* (2006.01)

(52) U.S. Cl.
CPC ..... *B65D 88/526* (2013.01)

(58) Field of Classification Search
CPC ... B65D 88/524; B65D 88/522; B65D 88/121; B65D 88/022; B65D 7/26; B65D 88/52; B65D 11/1826; B65D 90/0006; B65D 88/005; B65D 9/14; B65D 11/184; B65D 19/18; B65D 88/00
(Continued)

(56) References Cited

U.S. PATENT DOCUMENTS 578,445 A * 3/1897 Cobleigh ..... 217/14
702,237 A * 6/1902 McCullough ..... 217/15
(Continued)

FOREIGN PATENT DOCUMENTS

AU WO 2006133482 A1 * 12/2006 ..... E04B 1/3445
DE 2923199 A1 * 12/1980 ..... B65D 88/129
(Continued)

OTHER PUBLICATIONS

Multi-Disciplinary Engineering Design Conference, Project No. 06420; Collapsible Ocean Shipping Container—Automated, 2005 Rochester Institute of Technology, pp. 1-8.
(Continued)

*Primary Examiner* — King M Chu
(74) *Attorney, Agent, or Firm* — Baker & McKenzie LLP

(57) ABSTRACT

A foldable transport container substantially slides and folds so that the transport container can be folded and unfolded conveniently. In an example embodiment, a foldable transport container comprises a planar foldable base, a pair of opposing straight side walls, a pair opposing foldable end walls, a foldable top, and a folding mechanism. A first straight side wall is operable to slide towards a second straight side wall along a first longitudinal axis, and a first foldable end wall and a second foldable end wall are operable to fold inwardly towards each other along a second latitudinal axis. The folding mechanism allows surfaces of the first and second foldable base sections to be used for storing goods within the container without any interfering
(Continued)

protrusions when the foldable transport container is in its erected configuration.

9 Claims, 7 Drawing Sheets

(58) Field of Classification Search
USPC ..... 220/1.5, 6, 666, 4.28, 4.29, 7, 812, 826; 16/233, 235, 239, 241–243, 248, 365, 288, 16/370; 206/600; 217/13, 14, 15, 46; D3/272, D3/305; D34/1–11, 38
See application file for complete search history.

(56) References Cited

U.S. PATENT DOCUMENTS 954,322 A * 4/1910 Michael ..... B65D 7/26 220/6
989,074 A * 4/1911 Stall ..... 217/15
1,055,482 A * 3/1913 Miesen ..... B65D 7/26 220/6
1,113,608 A * 10/1914 Franks ..... B65D 7/26 220/6
1,114,860 A * 10/1914 Colombot ..... 217/15
1,164,755 A * 12/1915 Rouse ..... B65D 7/26 220/289
1,230,831 A * 6/1917 Ickes ..... B65D 11/1833 220/7
1,268,715 A * 6/1918 Hoffman ..... B65D 9/14 217/14
1,377,382 A * 5/1921 Wyman ..... B65D 9/14 217/15
1,488,418 A * 3/1924 Walther ..... B65D 7/16 220/7
1,496,965 A * 6/1924 Aldeen ..... 217/60 G
1,673,769 A * 6/1928 Graham ..... 220/6
1,972,483 A * 9/1934 Hartson ..... B65D 7/26 220/6
2,224,310 A * 12/1940 Merrett et al. ..... 5/99.1
2,355,542 A * 8/1944 Loftin ..... E05D 3/14 16/371
2,439,132 A * 4/1948 Hatala et al. ..... 220/88.1
2,520,921 A * 9/1950 Foster ..... 16/401
2,573,089 A * 10/1951 Armenia ..... B65D 9/14 217/15
2,797,524 A * 7/1957 Nelson ..... A01K 97/05 217/15
2,803,084 A * 8/1957 Frerking ..... 43/55
2,868,407 A * 1/1959 Woodcock ..... B65D 88/524 220/7
2,912,237 A * 11/1959 Snyder ..... 49/199
2,934,389 A * 4/1960 Krey ..... A47B 43/02 220/6
2,972,430 A * 2/1961 Johnson ..... B65D 9/18 220/1.5
3,130,850 A * 4/1964 Mynatt ..... B65D 88/524 217/15
3,195,506 A * 7/1965 Beard ..... A01K 1/0245 119/496
3,398,850 A * 8/1968 Kennard ..... B65D 88/524 217/14
3,451,718 A * 6/1969 Kaufman ..... 297/239
3,527,339 A * 9/1970 Cipolla ..... 206/290
3,570,698 A * 3/1971 Dougherty ..... 220/1.5
3,602,388 A * 8/1971 Hurkamp ..... 220/1.5
3,612,330 A * 10/1971 Baer ..... B65D 88/524 220/1.5
3,635,368 A * 1/1972 Winsor ..... B65D 88/522 220/6
3,684,122 A * 8/1972 Bonomi ..... B65D 88/522 220/1.5
3,752,349 A * 8/1973 Rana ..... B65D 88/524 217/14
3,765,556 A * 10/1973 Baer ..... B65D 88/022 220/1.5
3,796,342 A * 3/1974 Sanders ..... B65D 11/1826 220/1.5
3,799,384 A * 3/1974 Hurkamp ..... B65D 88/522 220/1.5
3,849,952 A * 11/1974 Hanaoka ..... E04B 1/3445 52/426
3,865,269 A * 2/1975 Coleman ..... 220/6
3,941,194 A * 3/1976 Orthman ..... A01B 73/044 16/262
4,035,964 A * 7/1977 Robinson ..... E04B 1/3445 217/14
4,074,766 A * 2/1978 Orthman ..... 172/311
4,099,640 A * 7/1978 Nessfield et al. ..... 220/6
4,122,638 A * 10/1978 O'Brian ..... A63H 33/008 217/14
4,162,737 A * 7/1979 Clive-Smith ..... B65D 88/522 206/512
4,177,907 A * 12/1979 Funaioli ..... B65D 88/522 217/14
4,214,669 A * 7/1980 McQuiston ..... 220/6
4,240,359 A * 12/1980 Howe ..... B65D 88/522 105/381
4,271,711 A * 6/1981 Vavra ..... A01B 73/04 172/311
4,314,686 A * 2/1982 Marz ..... B65D 88/522 105/384
4,355,732 A * 10/1982 Nessfield ..... B65D 88/522 108/55.3
4,356,776 A * 11/1982 Brodeur ..... B61D 17/08 105/404
4,382,312 A * 5/1983 Liggett et al. ..... 16/365
4,388,995 A * 6/1983 Ahn ..... B65D 88/524 220/1.5
4,400,994 A * 8/1983 Skjaeveland ..... 74/520
4,484,540 A * 11/1984 Yamamoto ..... A01K 1/0245 119/497
4,512,416 A * 4/1985 Smith ..... 172/776
4,527,303 A * 7/1985 Civitelli ..... 16/86 B
4,577,772 A * 3/1986 Bigliardi ..... 220/1.5
4,630,746 A * 12/1986 Fortenberry ..... 220/6
4,646,928 A * 3/1987 Ono ..... B65D 88/524 220/1.5
4,662,532 A * 5/1987 Anderson ..... B65D 19/12 220/1.5
4,674,647 A * 6/1987 Gyenge ..... B65D 19/18 220/1.5
4,726,486 A * 2/1988 Masuda ..... B65D 88/524 220/1.5
4,775,066 A * 10/1988 Keppeler ..... 220/484
4,775,069 A * 10/1988 Stonier ..... B42F 15/0094 220/6
4,793,507 A * 12/1988 Delplanque ..... B65D 9/14 206/600
4,798,304 A * 1/1989 Rader ..... B65D 11/1826 220/1.5
4,827,569 A * 5/1989 Mertes ..... 16/288
4,848,618 A * 7/1989 Yuan et al. ..... 220/1.5
4,862,758 A * 9/1989 Magee ..... A01B 73/044 172/311
4,913,301 A * 4/1990 Pickler ..... 414/403
4,913,302 A * 4/1990 Stonier ..... 220/6
5,038,953 A * 8/1991 Radar ..... B65D 11/1826 220/6
5,064,068 A * 11/1991 Sheng ..... 206/425
D325,278 S * 4/1992 van der Vlies ..... D3/272
5,107,639 A * 4/1992 Morin ..... E04B 1/3445 220/6
5,190,179 A * 3/1993 Richter ..... B65D 90/008 220/1.5
5,289,933 A * 3/1994 Streich et al. ..... 220/1.5
5,299,704 A * 4/1994 Thorby ..... B65D 7/26 220/6
5,429,261 A * 7/1995 Machino ..... B65D 11/184 220/4.28
5,538,320 A * 7/1996 Hoffman et al. ..... 297/188.1

(56) References Cited

U.S. PATENT DOCUMENTS 5,584,530 A * 12/1996 Rogers et al. ..... 297/188.1
5,669,331 A * 9/1997 Richmond ..... A01K 1/0245 119/497
5,890,612 A * 4/1999 Coppi ..... B65D 88/524 206/600
5,904,262 A * 5/1999 Coppi ..... 220/7
5,967,090 A * 10/1999 Hui ..... A01K 1/0245 119/453
6,050,410 A * 4/2000 Quirion ..... B65D 19/20 206/386
6,209,741 B1 * 4/2001 Boucher-Giles ... B65D 11/1833 220/4.28
6,299,011 B1 * 10/2001 Rosenfeldt ..... B65D 9/38 16/388
6,308,376 B1 * 10/2001 Koshikawa ..... 16/250
6,345,679 B1 * 2/2002 Sasaki ..... 180/274
6,382,327 B1 * 5/2002 Mosdal ..... 172/311
6,401,953 B2 * 6/2002 Kofod ..... B65D 19/12 220/1.5
6,401,995 B1 * 6/2002 Yuille ..... B60R 9/00 220/483
6,422,409 B2 * 7/2002 Kofod ..... B65D 7/26 220/7
6,499,189 B2 * 12/2002 Kondo et al. ..... 16/289
6,527,341 B1 * 3/2003 Martin ..... 297/332
6,616,003 B1 * 9/2003 Polenta ..... B65D 1/265 220/6
6,726,046 B2 * 4/2004 Orset ..... B65D 19/18 220/1.5
6,913,161 B2 * 7/2005 Schafer ..... B65D 11/26 220/4.28
6,926,194 B2 * 8/2005 Lane ..... B65D 11/1866 220/4.28
6,929,321 B1 * 8/2005 Shrock ..... 297/118
6,981,605 B2 * 1/2006 Kasuya ..... B65D 88/022 220/4.28
7,083,061 B2 * 8/2006 Spindel et al. ..... 220/6
7,100,241 B2 * 9/2006 Zetti ..... 16/304
7,197,790 B1 * 4/2007 Edmondson ..... 16/336
7,240,799 B2 * 7/2007 Zhang ..... B65D 88/129 206/600
7,290,663 B2 * 11/2007 Deng ..... B65D 25/107 206/454
7,296,704 B2 * 11/2007 Ferrini ..... B65D 88/522 220/1.5
7,418,766 B2 * 9/2008 Nelson et al. ..... 16/239
7,556,165 B2 * 7/2009 McDade ..... B65D 11/1826 220/4.28
7,574,775 B2 * 8/2009 Zetti ..... 16/370
7,647,731 B2 * 1/2010 Muir ..... E04B 1/3445 446/478
7,681,945 B1 * 3/2010 Wiecek et al. ..... 297/118
7,698,785 B2 * 4/2010 Bennett ..... 16/369
7,703,632 B2 * 4/2010 Kochanowski ..... B65D 88/005 217/12 R
7,722,101 B2 * 5/2010 Bellehumeur et al. .... 294/81.53
7,823,739 B2 * 11/2010 Sadkin et al. ..... 220/6
7,870,970 B2 * 1/2011 Fisk ..... 220/7
7,886,407 B2 * 2/2011 Resnik et al. ..... 16/286
7,984,819 B1 * 7/2011 Davis ..... B65D 88/524 220/1.5
8,011,523 B2 * 9/2011 Kochanowski ..... 220/1.5
8,113,372 B2 * 2/2012 Bellehumeur ..... B65D 88/524 220/1.5
8,251,237 B2 * 8/2012 Beaudonnet ..... 220/4.28
8,308,018 B2 * 11/2012 Kochanowski ..... B65D 88/005 217/12 R
8,573,433 B2 * 11/2013 Kochanowski ..... B65D 88/005 217/12 R
8,783,489 B2 * 7/2014 Bellehumeur ..... B65D 88/524 220/1.5
9,067,726 B2 * 6/2015 Kochanowski ..... B65D 88/005
2001/0035412 A1 * 11/2001 Kofod ..... B65D 19/12 220/7
2002/0084270 A1 * 7/2002 Metternich ..... B65D 90/008 220/1.5
2003/0052158 A1 * 3/2003 Spindel ..... B65D 11/1853 229/122.21
2003/0164374 A1 * 9/2003 Orset ..... B65D 19/18 220/7
2003/0213726 A1 * 11/2003 Kasuya ..... B65D 88/022 206/598
2004/0149753 A1 * 8/2004 Schafer ..... B65D 11/26 220/6
2004/0177476 A1 * 9/2004 Zetti ..... 16/287
2005/0139510 A1 * 6/2005 Zhang ..... B65D 88/129 206/600
2005/0279666 A1 * 12/2005 Deng ..... B65D 25/107 206/454
2006/0016807 A1 * 1/2006 Hsu ..... B65D 90/0006 220/1.5
2006/0043090 A1 * 3/2006 Ferrini ..... B65D 88/522 220/6
2006/0065655 A1 * 3/2006 Taylor ..... A45C 7/0036 220/6
2006/0130277 A1 * 6/2006 Nelson et al. ..... 16/327
2007/0006420 A1 * 1/2007 Zetti ..... 16/287
2007/0095825 A1 * 5/2007 Tsao ..... B65D 11/1826 220/6
2007/0108204 A1 * 5/2007 Warhurst ..... B65D 7/26 220/6
2008/0000900 A1 * 1/2008 Beaudonnet ..... 220/4.28
2008/0011742 A1 * 1/2008 Bellehumeur et al. ..... 220/1.5
2008/0011745 A1 * 1/2008 Ferrini ..... B65D 88/522 220/4.29
2008/0029508 A1 * 2/2008 Kochanowski ..... B65D 88/005 220/1.5
2008/0029510 A1 * 2/2008 Fisk ..... 220/7
2008/0135545 A1 * 6/2008 Sadkin et al. ..... 220/1.5
2008/0209820 A1 * 9/2008 Muir ..... E04B 1/3445 52/71
2010/0024162 A1 * 2/2010 Walz ..... 16/233
2010/0102056 A1 * 4/2010 Bellehumeur et al. ..... 220/6
2010/0187146 A1 * 7/2010 Kochanowski ..... B65D 88/005 206/503
2010/0292063 A1 * 11/2010 Chawla et al. ..... 493/409
2011/0284533 A1 * 11/2011 Kochanowski ..... B65D 88/005 220/6
2012/0138604 A1 * 6/2012 Bellehumeur ..... B65D 88/524 220/1.5
2013/0068763 A1 * 3/2013 Kochanowski ..... B65D 88/005 220/4.29
2014/0131348 A1 * 5/2014 Kochanowski ..... B65D 88/005 220/1.5

FOREIGN PATENT DOCUMENTS

DE EP 1277673 A1 * 1/2003 ..... B65D 88/524
DK WO 03033368 A1 * 4/2003 ..... B65D 88/126
GB 1007196 A * 10/1965 ..... B65D 9/14
GB 2214903 A * 9/1989 ..... B65D 88/121
JP 63307089 A * 12/1988
JP 09158592 A * 6/1997
JP 11334801 A * 12/1999
JP 2000085841 A * 3/2000
JP 2002264993 A * 9/2002 ..... B65D 88/52
WO 03024816 3/2003
ZA WO 9928215 A1 * 6/1999 ..... B65D 88/121

OTHER PUBLICATIONS

P06420 Collapsible Ocean Shipping Container—Automated Multidisciplinary Senior Design Preliminary Design Report, Feb. 2006, pp. 1-125.

* cited by examiner

FOLDABLE TRANSPORT CONTAINER WITH HORIZONTALLY SLIDABLE SIDE WALLS AND METHOD FOR FOLDING SAID CONTAINER

FIELD OF THE INVENTION

This invention relates to a folding/unfolding transport container and a method of folding and unfolding a transport container.

BACKGROUND OF THE INVENTION

Boxes are commonly used in transporting, moving, conveying, sorting and storing goods and materials, and are employed by a diversity of industries such as trucking, warehousing, manufacturing, office moving and household goods moving.

Large-capacity containers are used for easy transfer of goods and cargo from one transporting vehicle to another or for shipping cargo overseas or overland.

Containers have been universally adopted for the transportation of cargo because this form of shipment has eliminated the need for transferring the cargo manually or by conventional means from one vehicle to another during the transport to a certain destination.

The main disadvantage of conventional containers which are formed by a rigid prismatic structure results from the fact that after use and delivery, the empty containers must be transported from their destination to a point of loading from where they are shipped back to points of re-use.

The requirement to reposition empty containers is one of the more persistent problems in the container transport industry. Empty container transport involves high costs, particularly for shipping lines, since they generally bear these container management costs. Not surprisingly, shipping lines try to reduce the costs of moving empty containers as much as they can. Most strategies are focused on matching cargo with empty containers. Due to trade imbalances transport movements of empty containers remain to some extent unavoidable.

These operations are economically disadvantageous because the empty container, which is a rigid structure, occupies in the transporting means a space which otherwise could be occupied by containers with cargo.

Therefore, foldable containers are an attractive option from the point of view of saving transport costs as well as handling and storage costs. So far, however, such containers have not been introduced successfully.

In order to eliminate these disadvantages resulting from the use of rigid-structure, prismatic containers, containers with collapsible structure components have been designed and built. In such containers the walls can be folded onto the base so that after discharge of the cargo, the empty container will occupy less space in the collapsed state for transport.

Containers with folding walls usually comprise reinforcing or retaining members of the walls. These members may get lost and therefore may cause serious inconvenience in the assembly or unloading of such containers with complicated structure elements.

Collapsible containers of this type are a solution to the problem of dead space occupied once the cargo has been delivered since in the collapsed state, the height of the containers is substantially reduced and at least four collapsible containers can be transported in place of one rigid container.

When special designs are incorporated in the hinge joints to prevent the entry of foreign material, it is hard to obtain the required sealing effect because in prolonged use of the containers, a number of problems develop at the hinge joints. The problems and failures cause additional expenses with the resulting disadvantages in the handling of this type of cargo containers. U.S. Pat. No. 4,177,907 relates to a shipping container for the transport of goods. This container has all its walls connected together by means of hinges and thus in the folding down operation, as in the reverse one of erection, no wall is completely freed from the remaining ones. It discloses that the maneuvers consequently become quicker and safer and the structure of the container assumes greater rigidity in comparison with those containers in which one or more walls have to be detached completely. This container on folding/collapsing folds vertically down to the base.

U.S. Pat. No. 4,630,746 provides an improved collapsible, stackable storage or shipping container in which the respective walls, end sections and corresponding hinge elements by which the sections are pivotally connected are all formed of a molded plastic material and wherein each of the corresponding adjacent pivotally connected walls or wall sections and their corresponding aligned hinge elements are interconnected by transverse pivot pins of plastic or metal.

However, the above-mentioned patents do not disclose a foldable transport container which substantially folds horizontally against a side wall and in which the process of folding can be facilitated using external automatic apparatus.

OBJECT AND SUMMARY OF THE INVENTION

To obviate the aforesaid drawback, the present invention provides a transport container which can be folded and unfolded conveniently.

It is another object of the present invention to provide a transport container which can be folded and unfolded automatically using an apparatus rather than manually.

BRIEF DESCRIPTION OF THE ACCOMPANYING DRAWINGS

The features of this invention are set forth with particularly in the appended claims. The invention, together with its objects and advantages thereof may be best understood by reference to the following description taken in conjunction with the accompanying drawings, in which like reference numerals identify substantially like elements in the several figures and in which:

DETAILED DESCRIPTION OF THE INVENTION

Figure 1:
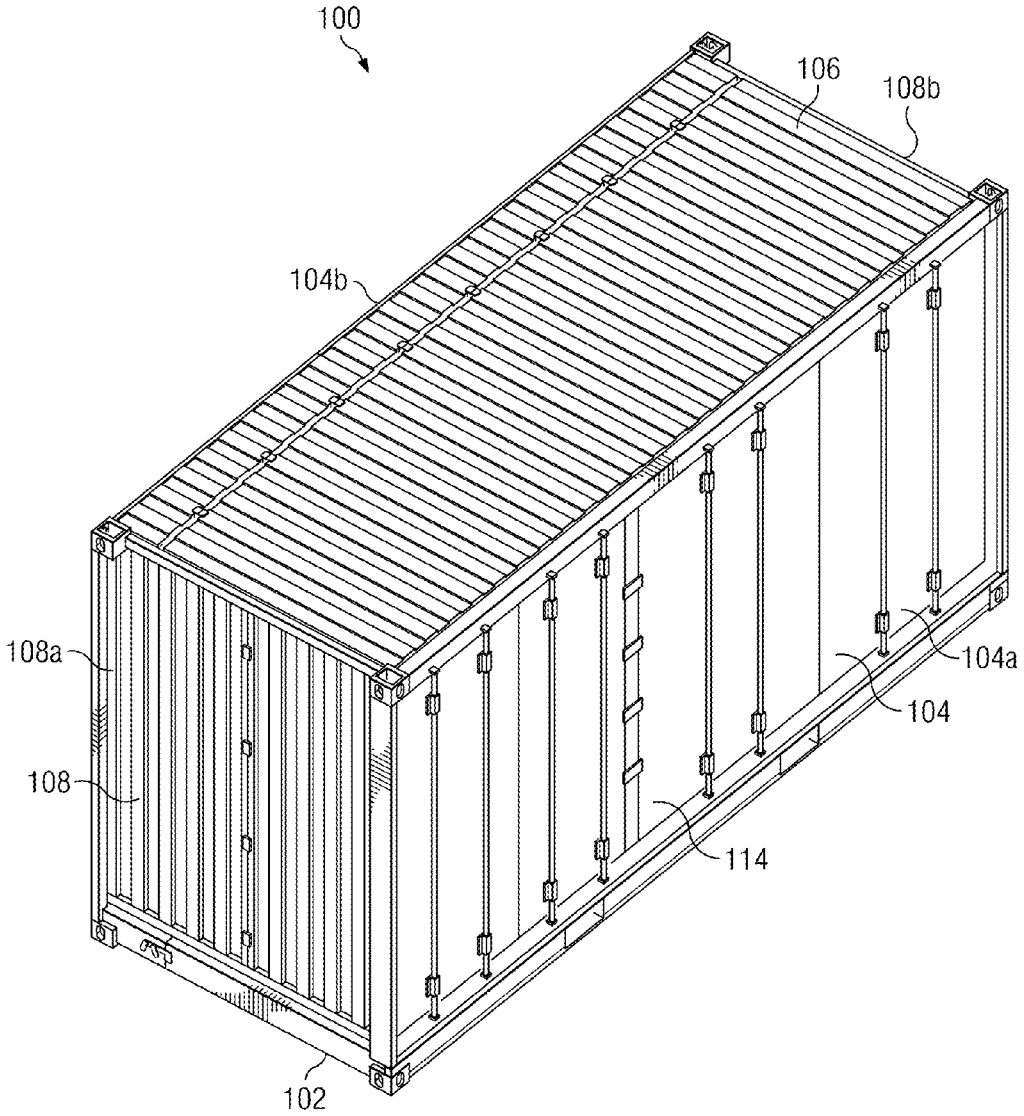
FIG. 1 depicts a schematic diagram of a foldable transport container according to one embodiment of the present disclosure.

For the purpose of promoting an understanding of the principles of the disclosed embodiments, reference will now be made to the embodiments illustrated in the drawings and specific language will be used to describe the same. It will nevertheless be understood that no limitation of the scope of the disclosure is thereby intended and such further applications of the principles of the disclosed embodiments as illustrated therein being contemplated as would normally occur to one skilled in the art to which the disclosure relates.

Figure 2:
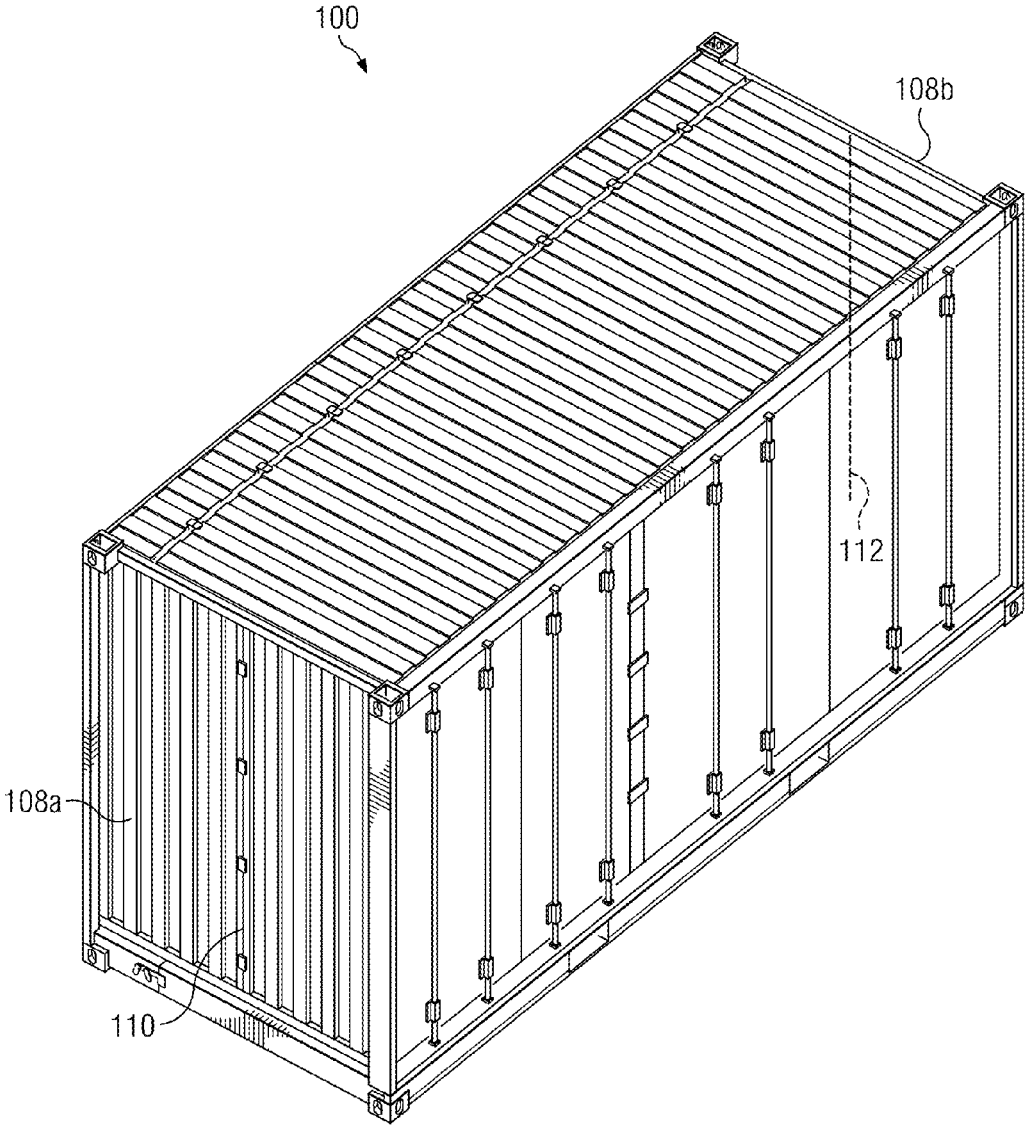
FIG. 2 depicts a schematic diagram of first and second foldable sides of the foldable transport container of FIG. 1 according to one embodiment of the present disclosure.

FIG. 1 depicts a schematic diagram of a foldable transport container 100 according to one embodiment of the present disclosure. FIG. 2 depicts a schematic diagram of first and second foldable sides of the foldable transport container of FIG. 1 according to one embodiment of the present disclosure. The foldable transport container 100 comprises a planar foldable base 102, a foldable top 106, two opposing foldable end walls 108, and two opposing straight side walls 104. The two opposing straight side walls 104 may be connected to the planar foldable base 102 and may be connected to the foldable top 106. The two foldable end walls 108 may be connected to the planar foldable base 102, to the foldable top 106, and to the opposing straight side walls.

The two opposing foldable end walls 108 may comprise a first foldable end wall 108*a* and a second foldable end wall 108*b*. The two opposing straight side walls 104 may comprise a first straight side wall 104*a* and a second straight side wall 104*b*. The first straight side wall 104*a* or the second straight side wall 104*b* may comprise one or more doors 114 that may be operable to facilitate loading/unloading of the foldable transport container 100. During the folding process, the first straight side wall 104*a* may slidably move along a first longitudinal axis towards the second straight side wall 104*b* in a first step. The first longitudinal axis may run between first and second straight side walls 104*a*, 104*b*. These sides 104*a*, 104*b* may not have any folding hinges and may be straight. The planar foldable base 102 may be divided into two or more sections. For example, the planar foldable base 102 may comprise a first planar foldable base section 102*a* and a second planar foldable base section 102*b*. The straight side walls 104*a*, 104*b* and the foldable end walls 108*a*, 108*b* of the foldable transport container 100 may comprise sealing mechanisms to prevent entry of liquids into the container. The straight side walls 104*a*, 104*b* and the foldable end walls 108*a*, 108*b* of the foldable transport container 100 may also comprise one or more openings at doors 114 to facilitate the loading and unloading of the foldable transport container 100.

The first and second foldable end walls 108*a*, 108*b* may fold inwardly in a zig-zag manner into two or more folds, along folding edges 110, 112. As shown in FIG. 2, the first and second foldable end walls 108*a*, 108*b* are schematically shown with one folding mechanism, for example a hinge, along edges 110, 112 in the middle of the first and second foldable end walls 108*a*, 108*b*, the edges 110, 112 running in a substantially vertical direction in relation to the foldable transport container 100 between the foldable top 106 and the planar foldable base 102, resulting in two-fold first and second foldable end walls 108*a*, 108*b*. During the folding process, the first and second foldable end walls 108*a* and 108*b* may fold inwards along a second latitudinal axis that is operable to facilitate the sliding of the first opposing straight side wall 104*a* towards the second opposing straight side wall 104*b*. The second latitudinal axis may run between first and second foldable end walls 108*a*, 108*b*.

Figure 3:
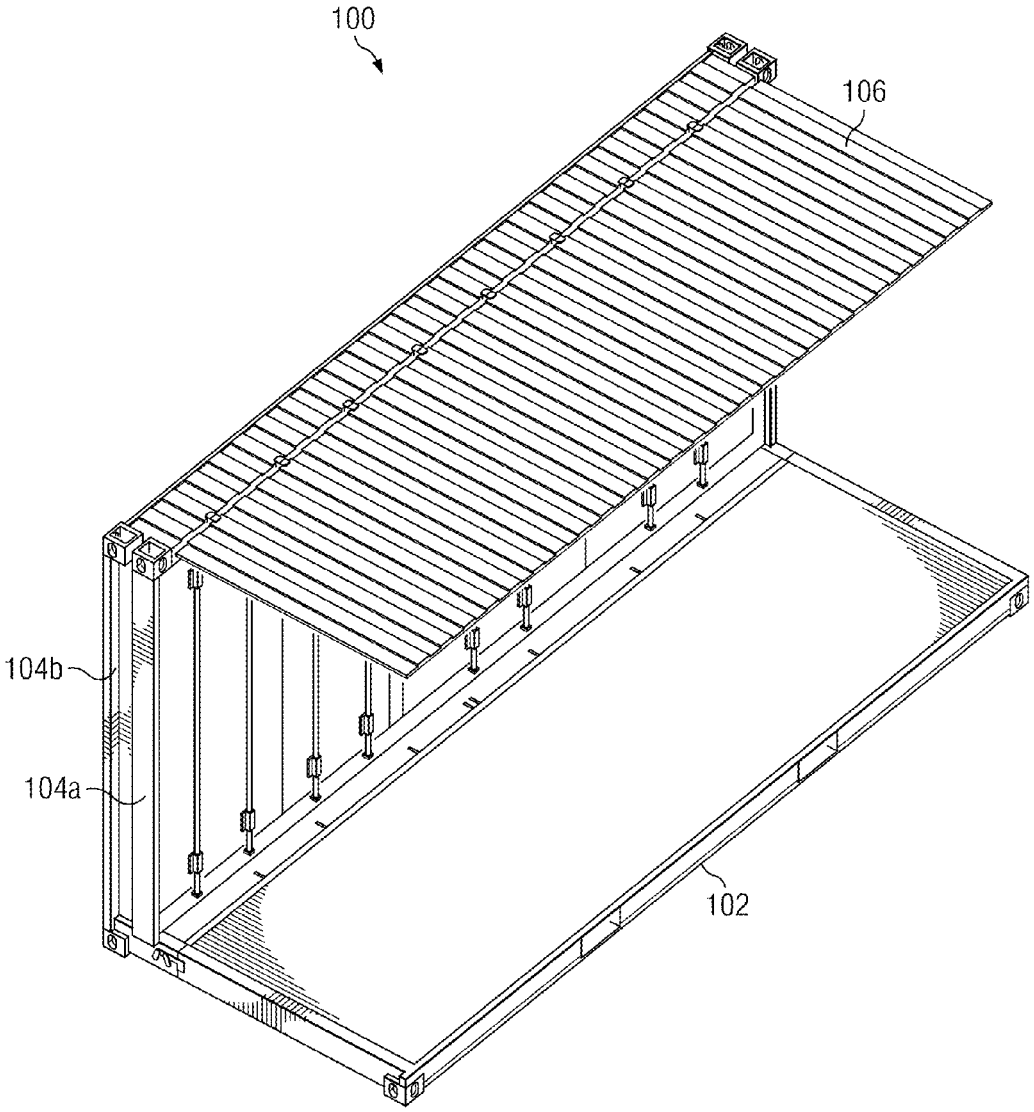
FIG. 3 depicts a schematic diagram of a folded state of the foldable transport container after the first folding step of FIG. 2 according to one embodiment of the present disclosure.

FIG. 3 depicts a schematic diagram of a folded state of the foldable transport container 100 after the first folding step of FIG. 2 according to one embodiment of the present disclosure.

In the first step of folding the foldable transport container 100, the first straight side wall 104*a* may be slidably moved towards the second straight side wall 104*b* along the first longitudinal axis, and the first and second foldable end walls 108*a*, 108*b* may be simultaneously folded inwards towards each other along the second latitudinal axis.

Figure 4:
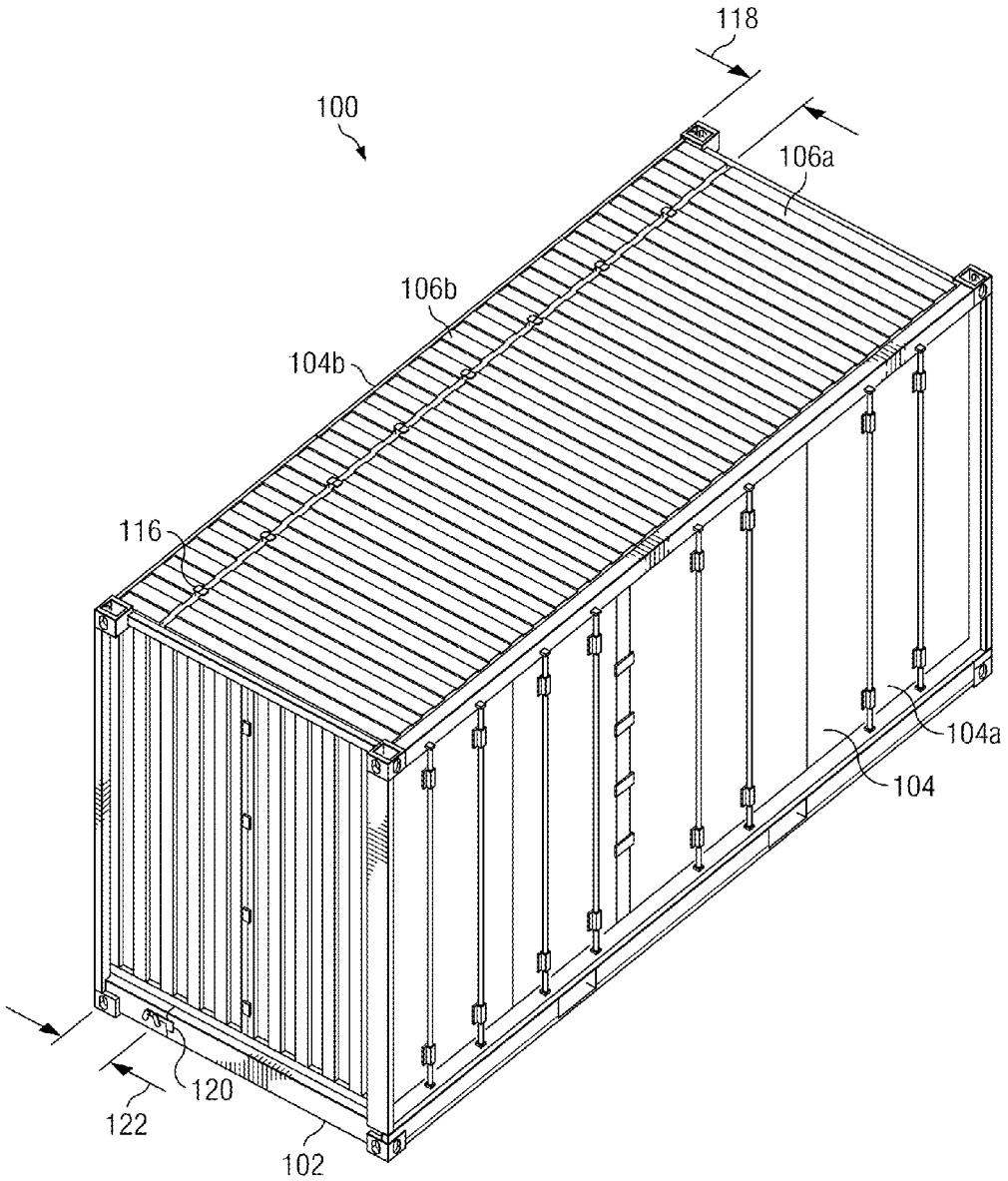
FIG. 4 depicts a schematic diagram of a planar foldable base and a foldable top of the foldable transport container of FIG. 3 according to one embodiment of the present disclosure.

FIG. 4 depicts a schematic diagram of the planar foldable base 102 and a foldable top 106 of the foldable transport container 100 of FIG. 3 according to one embodiment of the present disclosure. The foldable top 106 may be folded along a folding line 116. The folding line 116 may comprise a hinge parallel to the first and second straight side walls 104*a*, 104*b* at a distance 118 from the second straight side wall 104*b*. When the foldable top 106 hinges along the folding line 116, the foldable top 106 may comprise a first foldable top section 106*a* and a second foldable top section 106*b*. The first foldable base section 102*a* has a folding line 120 parallel to the second straight side wall 104*b* at a distance 122 from the second straight side wall 104*b* to the folding line 120. In an embodiment, the distance 122 may be greater than the distance 118.

Figure 5:
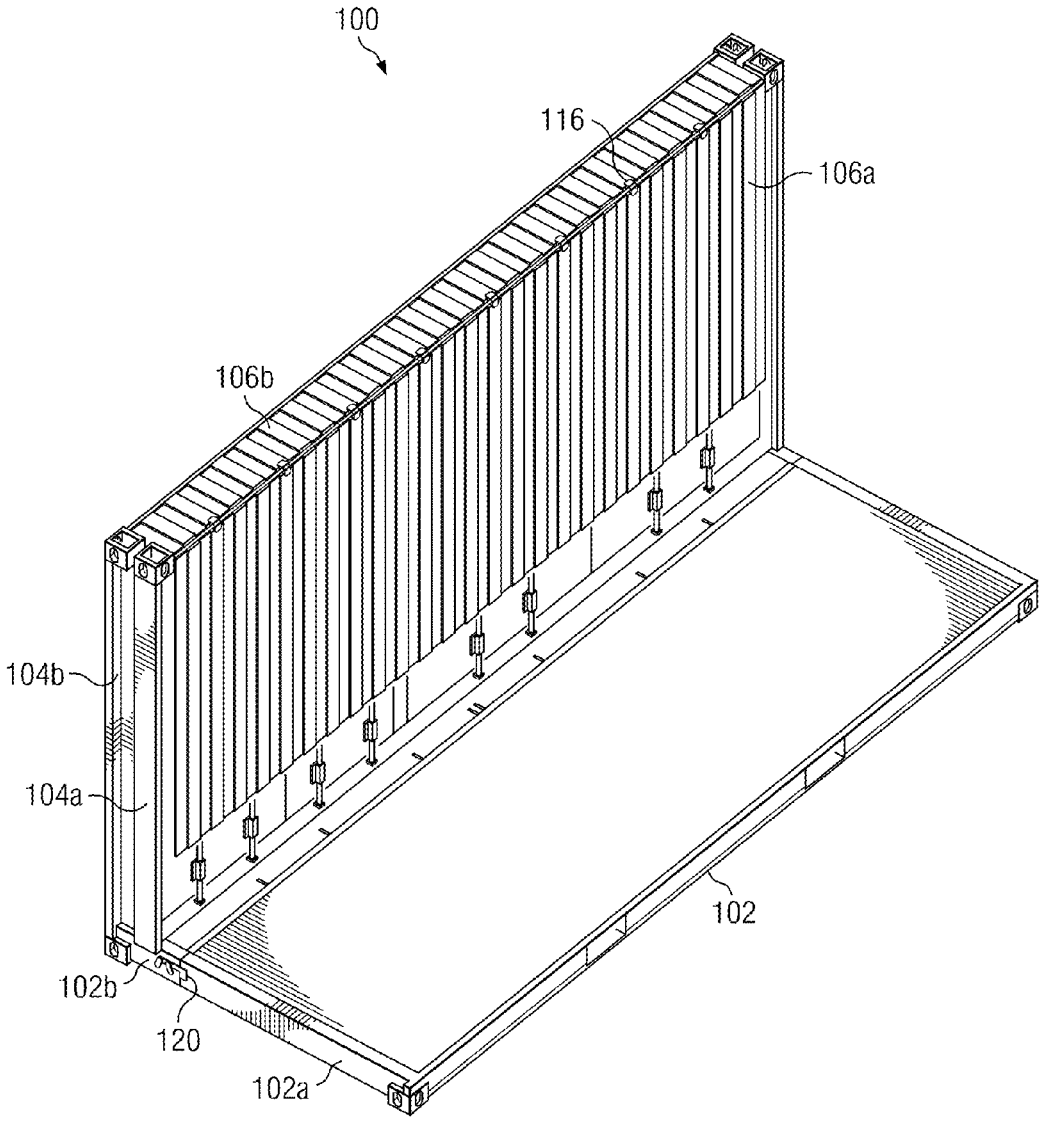
FIG. 5 depicts a schematic diagram of the folded state of the foldable transport container after a second folding step of FIG. 4 according to one embodiment of the present disclosure.

FIG. 5 depicts a schematic diagram of the folded state of the foldable transport container 100 after the second folding step of FIG. 4 according to one embodiment of the present disclosure. FIG. 5 depicts the foldable transport container 100 with the first straight side wall 104*a* slid against and adjacent to the second straight side wall 104*b*, the first and second foldable end walls (not shown) folded inwardly, and the foldable top 106 folded at the folding line 116 so that the first foldable top section 106*a* is substantially parallel to the first straight side wall 104*a* and the second foldable top section 106*b* is substantially perpendicular to the first straight side wall 104*a*. FIG. 5 also depicts the folding line 120 in the planar foldable base 102, which may be a hinge and may separate the planar foldable base 102 into the first foldable base section 102*a* and the second foldable base section 102*b*.

Figure 6:
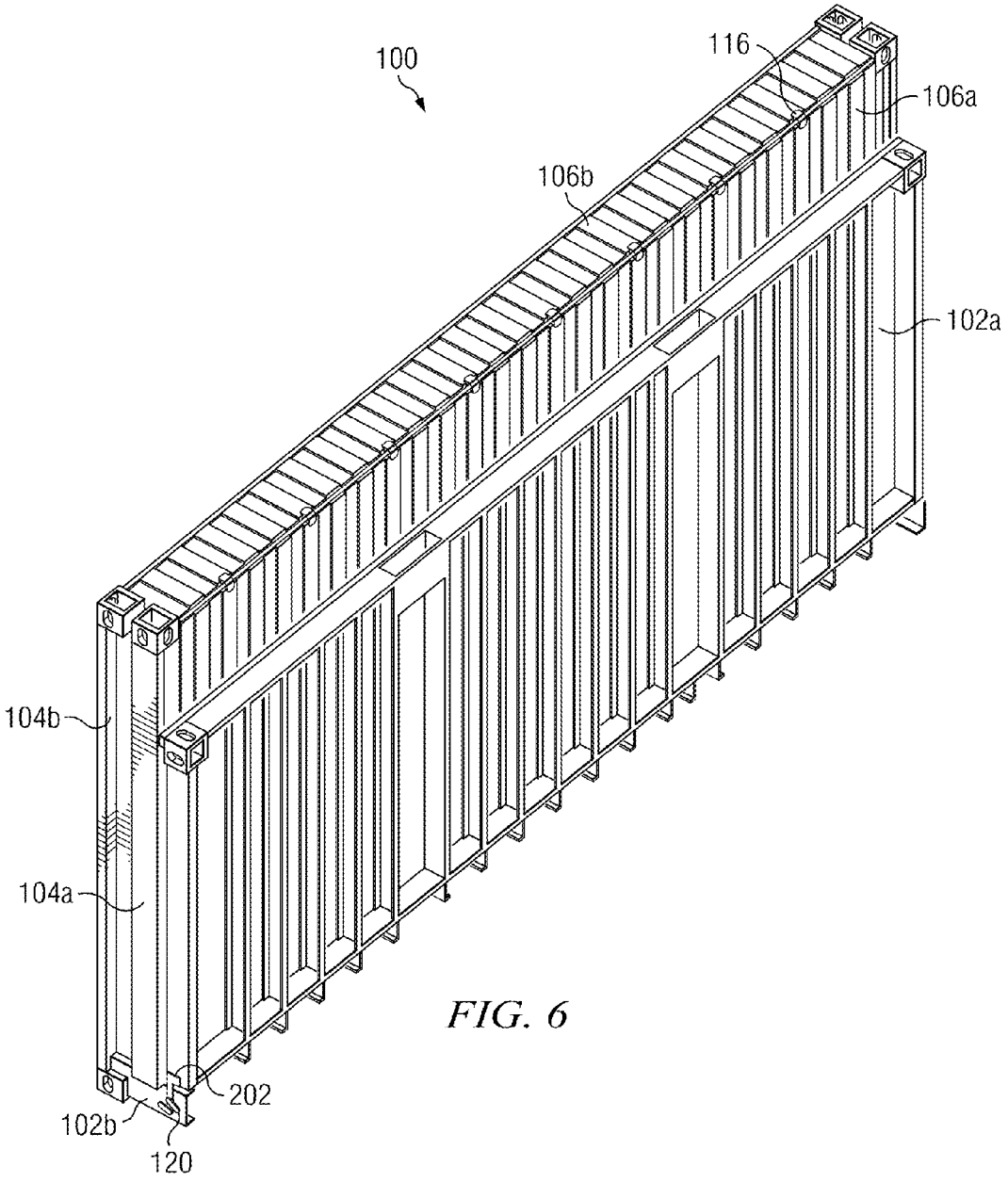
FIG. 6 depicts a schematic diagram of the final folded condition of the foldable container of FIG. 5 according to one embodiment of the present disclosure.

FIG. 6 depicts a schematic diagram of the final folded state of the foldable container of FIG. 5 according to one embodiment of the present disclosure. Compared to FIG. 5, in FIG. 6, the first foldable base section 102*a* has been folded parallel to the first straight side wall 104*a* along the folding line 120.

Figure 7:
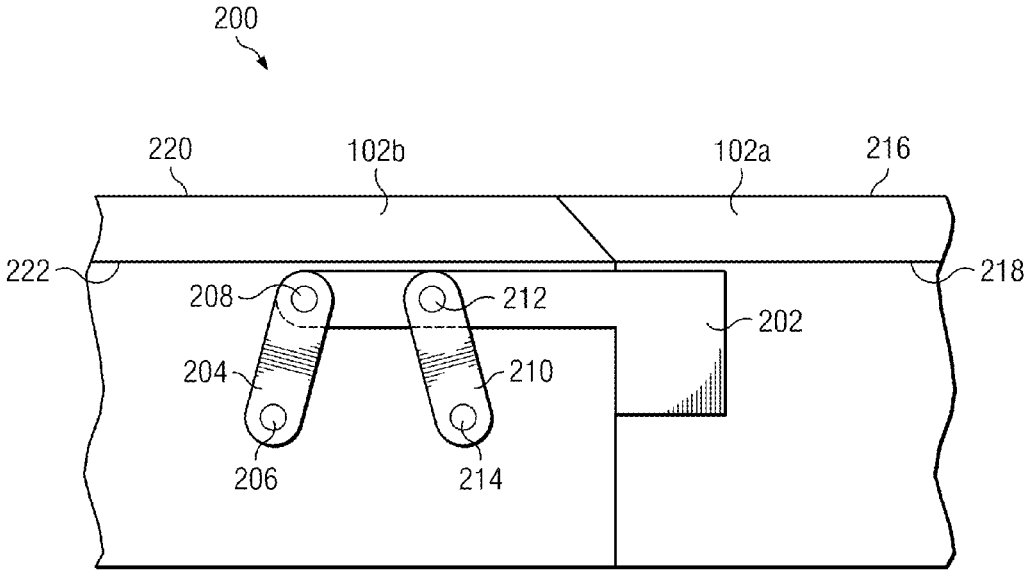
FIG. 7 depicts a schematic diagram of a base folding mechanism to fold the base of the foldable transport container of FIG. 1 in a first, starting position according to one embodiment of the present disclosure.
Figure 8:
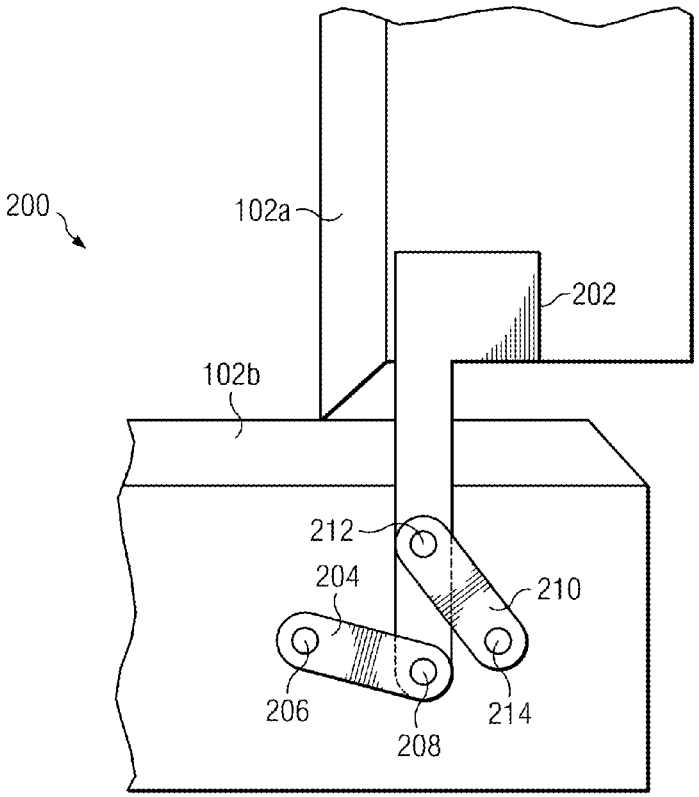
FIG. 8 depicts a schematic diagram of the base folding mechanism of FIG. 7 in a second, final position according to one embodiment of the present disclosure.

FIG. 7 depicts a schematic diagram of a base folding mechanism 200 to fold the base of the foldable transport container 100 of FIG. 1 in a first, starting position according to one embodiment of the present disclosure. FIG. 8 depicts a schematic diagram of the base folding mechanism of FIG. 7 in a second, final position according to one embodiment of the present disclosure. The base folding mechanism 200 may be used to attach one or more hinges to one or more thick plates, such as first foldable base section 102*a* and second foldable base section 102*b*, so that there are no gaps at the hinge. From the first, starting position, as shown in FIG. 7, to the second, final position, as shown in FIG. 8, the first foldable base section 102*a* is rotated approximately 90 degrees from the second foldable base section 102*b*. As shown in FIG. 7 and FIG. 8, the base folding mechanism 200 is such that the base folding mechanism 200 does not protrude onto a first (top) surface 216 and a second (bottom) surface 218 of the first foldable base section 102*a* or protrude onto a first (top) surface 220 and a second (bottom) surface 222 of the second foldable base section 102*b*. As such, the first surface 216 and the second surface 128 of the first foldable base section 102*a* as well as the first surface 220 and the second surface 222 of the second foldable base section 102*b* may be uninterrupted and may be used for keeping goods without any interfering objects or protrusions when the foldable transport container 100 is in either its erected arrangement or in its folded arrangement.

As can be seen in FIGS. 7 and 8, a first link 202 may be rigidly connected to the first foldable base section 102*a*. A second link 204 may be connected to the second foldable base section 102*b* at a first rotation axis 206 at one end and at the other end to the first link 202 at a second rotation axis 208. A third link 210 may be connected to the first link 202 at one end at a third rotation axis 212 and to the second foldable base section 102*b* at the other end at a fourth rotation axis 214.

As shown in FIG. 8, after the first foldable base section 102*a* is rotated approximately 90 degrees from the second foldable base section 102*b*, there is no interference between first and second foldable base sections 102*a*, 102*b* either during or after the folding.

We claim:

1. A foldable transport container comprising:

a planar foldable base comprising two or more foldable base sections, wherein the two or more foldable base sections are operable to fold in relation to each other, and wherein one of the two or more foldable base sections is operable to fold upward from a horizontal orientation to a vertical orientation;

a foldable top comprising at least two adjacent sections connected to each other by a top folding mechanism that is operable to facilitate a folding of the foldable top, wherein one of the at least two adjacent sections is operable to fold downward from a horizontal orientation to a vertical orientation;

a first straight side wall and a second straight side wall each connected to the planar foldable base and to the foldable top, wherein the first straight side wall is operable to horizontally slide on the planar foldable base towards the second straight side wall along an axis defined on the planar foldable base as the first straight side wall slides towards the second straight side wall; and a first foldable end wall and a second foldable end wall each connected to the planar foldable base, the foldable top, and the first and second straight side walls, wherein the first and second foldable end walls each comprise a first and second fold, the first and second folds connected to each other by an end wall folding mechanism, the end wall folding mechanism operable to fold the first and second folds of the first and second foldable end walls inwardly along a second axis perpendicular to the axis and defined on the planar foldable base so as to facilitate the sliding of the first straight side wall towards the second straight side wall while one of the foldable base sections remains in the horizontal orientation, wherein the first foldable end wall and the second foldable end wall each remain connected to the planar foldable base, the foldable top, and the first and second straight side walls as the first straight side wall horizontally slides on the planar foldable base towards the second straight side wall; and a base folding mechanism comprising a plurality of links and the two or more foldable base sections, wherein the two or more foldable base sections comprise a first base section and a second base section, wherein the plurality of links comprise a first link, a second link, and a third link, wherein the first link is connected to the first base section, wherein the second link is connected to the second base section by a first rotation axis at a first end of the second link and is connected to the first link by a second rotation axis at a second end of the second link, wherein the third link is connected to the first link by a third rotation axis at a first end of the third link and is connected to the second base section by a fourth rotation axis at a second end of the third link, wherein when the first base section is substantially parallel to the second base section, the first rotation axis and the fourth rotation axis are located along the same edge of the first link, and wherein when the first base section is substantially perpendicular to the second base section, the first rotation axis and the fourth rotation axis are located along opposite edges of the first link.

2. The foldable transport container as claimed in claim 1, wherein when the first base section is substantially perpendicular to the second base section, the first link is substantially parallel to the first base section and substantially perpendicular to the second base section, and wherein when the first base section is substantially parallel to the second base section, the first link is substantially parallel to both the first base section and the second base section.

3. The foldable transport container as claimed in claim 1, wherein the base folding mechanism is a hinge.

4. The foldable transport container as claimed in claim 1, wherein at least one of the base folding mechanism, the top folding mechanism, and the end folding mechanism are further operable to prevent entry of fluids into the container.

5. The foldable transport container as claimed in claim 1, wherein the planar foldable base, the foldable top, the first and second straight side walls, and the first and second foldable end walls are operable to facilitate the loading and unloading of the container.

6. A foldable transport container comprising:

a planar foldable base comprising a first base section and a second base section, wherein the first base section and the second base section are connected to each other by a base folding mechanism;

a foldable top comprising at least two adjacent sections connected to each other by a top folding mechanism that is operable to facilitate a folding of the foldable top, wherein one of the at least two adjacent sections is operable to fold downward from a horizontal orientation to a vertical orientation;

a first straight side wall and a second straight side wall each connected to the planar foldable base and to the foldable top, wherein the first straight side wall is operable to horizontally slide on the planar foldable base towards the second straight side wall along an axis defined on the planar foldable base as the first straight side wall slides towards the second straight side wall;

a first foldable end wall and a second foldable end wall each connected to the planar foldable base, the foldable top, and the first and second straight side walls, wherein the first and second foldable end walls each comprise a first and second fold, the first and second folds connected to each other by an end wall folding mechanism operable to fold the first and second foldable end walls inwardly along a second axis perpendicular to the axis and defined on the planar foldable base so as to facilitate the sliding of the first straight side wall towards the second straight side wall while the first base section or the second base section remains in a horizontal orientation; and the base folding mechanism comprising a plurality of links wherein:

the plurality of links comprise a first link, a second link, and a third link;

the first link is connected to the first base section, the second link is connected to the second base section by a first rotation axis at a first end of the second link and is connected to the first link by a second rotation axis at a second end of the second link, the third link is connected to the first link by a third rotation axis at a first end of the third link and is connected to the second base section by a fourth rotation axis at a second end of the third link, wherein when the first base section is substantially parallel to the second base section, the first rotation axis and the fourth rotation axis are located along the same edge of the first link, and wherein when the first base section is substantially perpendicular to the second base section, the first rotation axis and the fourth rotation axis are located along opposite edges of the first link.

7. A foldable transport container comprising:

a planar foldable base comprising a first foldable base section and a second foldable base section operable to fold in relation to each other, wherein one of the two or more foldable base sections is operable to fold upward from a horizontal orientation to a vertical orientation;

a first straight side wall and a second straight side wall each connected to the planar foldable base, wherein the first straight side wall is operable to horizontally slide on the planar foldable base towards the second straight side wall along an axis defined on the planar foldable base as the first straight side wall slides towards the second straight side wall;

a first foldable end wall and a second foldable end wall each connected to the planar foldable base and the first and second straight side walls, wherein the first foldable end wall and the second foldable end wall each remain connected to the planar foldable base and the first and second straight side walls as the first straight side wall horizontally slides on the planar foldable base towards the second straight side wall; and a base folding mechanism comprising a first link connected to the first base section, wherein the first link is connected to the second base section by a first connection to a second link, the first connection configured to travel on a first rotational path, and wherein the first link is connected by a second connection to a third link, the second connection configured to travel on a second rotational path independent from the first rotational path.

8. The foldable transport container as claimed in claim 7, wherein:

the first connection and the second connection define an axis that is substantially parallel to the second base section when the first base section is substantially parallel to the second base section, and the first connection and the second connection define an axis that is substantially perpendicular to the second base section when the first base section is substantially perpendicular to the second base section.

9. The foldable transport container as claimed in claim 8, wherein at least one of the base folding mechanism, the top folding mechanism, and the end folding mechanism are further operable to prevent entry of fluids into the container.

* * * * *